United States Patent [19]

Hansen et al.

[11] 4,169,358

[45] Oct. 2, 1979

[54] DEFROSTING APPARATUS FOR A REFRIGERATOR

[75] Inventors: Børge M. Hansen, Sonderborg; Per Andersen, Nordborg; Uwe W. Hoppmann, Sonderborg; Hans J. Bebe, Nordborg, all of Denmark

[73] Assignee: Danfoss A/S, Nordborg, Denmark

[21] Appl. No.: 856,645

[22] Filed: Dec. 2, 1977

[30] Foreign Application Priority Data

Dec. 7, 1976 [DE] Fed. Rep. of Germany ..... 2655315

[51] Int. Cl.[2] ..... F25D 21/08

[52] U.S. Cl. ..... 62/154; 62/155; 62/234

[58] Field of Search ..... 62/154, 155, 234, 276

[56] References Cited

U.S. PATENT DOCUMENTS

| | | | |
|---|---|---|---|
| 2,129,373 | 9/1938 | Grooms | 62/154 |
| 2,500,298 | 3/1950 | Smith | 62/154 |
| 2,708,348 | 5/1955 | Philipp | 62/154 |
| 2,737,025 | 3/1956 | Soreng et al. | 62/154 |
| 2,949,016 | 8/1960 | Thorner | 62/154 |
| 2,970,454 | 2/1961 | Everard et al. | 62/154 |
| 3,374,643 | 3/1968 | Thorner | 62/154 |

*Primary Examiner*—William Pate, III

*Attorney, Agent, or Firm*—Wayne B. Easton

[57] ABSTRACT

The invention relates to a refrigeration assembly and particularly to defrosting apparatus therefor. The assembly includes a bellows operated thermostatic motor switch responsive to evaporator temperatures for operating the compressor motor. After a predetermined number of operating cycles of the compressor the defrost apparatus is actuated. There is a linkage between the bellows and the motor switch with a main spring acting thereon to oppose the bellows and a differential spring acting thereon to assist the bellows. The differential spring is made inoperative by the defrosting unit during the defrost setting. The main spring and the differential spring are calibrated so that when both springs are effective the motor switch is actuated at a predetermined evaporator temperature. When only the main spring is effective during the defrost setting the motor switch is actuatable at an evaporator temperature higher than the above referred to temperature.

8 Claims, 4 Drawing Figures

DEFROSTING APPARATUS FOR A REFRIGERATOR

The invention relates to a defrosting apparatus for a refrigerator of which the evaporator thermostat has a contact for switching the compressor off at a switching off temperature and switching it on at a higher switching on temperature, comprising a defrosting time generator which, on responding, operates a switching device which suppresses switching on of the compressor until a defrosting temperature independent of the switching on temperature is reached and which possibly switches on a defrosting heater.

In a known defrosting apparatus of this kind, two thermostats dependent on the evaporating temperature are provided, namely the normal refrigerator thermostat and a defrosting thermostat. The time generator actuates a reversing contact which, in the operating position, is in series with the contact of the refrigerator thermostat and the compressor. In the operating position, the connection to the reversing contact of the defrosting thermostat is made, the latter switching on an electric defrosting heater at a predetermined defrosting temperature and making the connection to the contact of the refrigerator thermostat when reaching the defrosting temperature. Such a defrosting apparatus is expensive particularly because of using two thermostats.

A defrosting apparatus is also known in which only a single thermostat is used. This comprises an operating element in the form of a bimetallic spiral which is adjacent the evaporator and the free end of which is in the form of a radial arm which actuates a first contact for switching the compressor on when deflected in one direction and actuates a second contact for switching an electric defrosting heating resistor on when deflected in the other direction. The radial arm is provided with an abutment which normally prevents actuation of the second contact. Only when the abutment engages in a recess of a defrosting time generator in the form of a ratchet wheel can the radial arm move towards the second contact by overcoming the force of a snap spring. However, the defrosting temperature is not dependent on the set switching on and switching off temperatures. The defrosting temperature and switching on temperature are equal.

The invention is based on the problem of providing a defrosting apparatus of the aforementioned kind, wherein, whilst using only one thermostat, the defrosting temperature is independent of the normal switching on temperature and switching off temperature and in particular can have a higher value than the switching on temperature.

This problem is solved according to the invention in that the evaporator thermostat comprises a snap contact with switching hysteresis and a contact actuating element which is loaded by an operating element exerting a temperature-dependent force, a differential spring acting in the same sense and adjustable to change the switching off temperature and an oppositely acting main spring, that the activated switching device breaks the connection between the differential spring and actuating element, and that the main spring is designed so that, when acting alone, the contact is switched on at defrosting temperature. In this construction, an evaporator thermostat fulfills two functions. When the main spring and the differential spring act in unison, a normal refrigerator thermostat is obtained of which the switching off temperature and thus also the switching on temperature is adjustable by changing the tension of the differential spring. If however the differential spring was made inoperative and the main spring acts alone, one obtains a defrosting thermostat which keeps its contact controlling the compressor open until the defrosting temperature has been reached. Since the main spring can already be set to a fixed defrosting temperature in the factory and settings are merely made to the differential spring during operation, the differential spring being inoperative at the end of the defrosting period, one obtains the desired independence between the defrosting temperature and the normal switching on and off temperature. By reason of using a single evaporator thermostat, the constructional expense is considerably reduced.

It is advantageous if the differential spring acts on a transmission element which has a force connection to the actuating element, and if the switching device has an abutment which can be placed in the path of the transmission element. The abutment stops the motion of the transmission element and therefore uncouples the differential spring and actuating element.

The operating element may be bellows of a thermostatic system operating with a liquid-vapour filling. Such bellows produce an accurately defined force in dependence on the temperature of the sensor lying against the evaporator.

In a preferred embodiment, it is ensured that the defrosting time generator and switching device are mounted on the outside of the housing for the evaporator thermostat and that the housing wall has an aperture through which the transmission element and the abutment interengage. With this sub-division, the evaporator thermostat can be a mass produced article which is selectively operated with and without an automatic defrosting mechanism.

In this connection it is recommended that the transmission element should be a lever having an extension extending out through the wall aperture and that the abutment can be placed in the path of travel of the extension. The outwardly projecting end of such a lever can move a comparatively large distance in which the abutment can be introduced without difficulty.

In a preferred embodiment, the switching device comprises a locking lever which is pivotable by the defrosting time generator and can be loaded in the longitudinal direction by the transmission element. In this way relatively small forces are sufficient to adjust the abutment whereas the locking lever can take up considerable forces from the differential spring and transmit them to the joint.

Further, it is favourable if the defrosting time generator comprises a ratchet wheel of which the driving means are actuatable in response to the contact of the thermostat. In this way the thermostat contact assumes yet another function without affecting the remaining manner of operation.

The ratchet wheel can for example comprise a cam which adjusts the switching device. In particular, the locking lever and its pivotal axis may lie in a plane parallel to the plane of the ratchet wheel and the cam may extend laterally from the ratchet wheel and act by way of a leaf spring on the locking lever which is loaded in the opposite sense by a weaker return spring. This gives a particularly compact construction which can be mounted flat on a housing wall of the thermostat.

The driving means for the ratchet wheel are preferably an electromagnet of which the coil is in series with the thermostat contact. Every time the compressor motor is switched on, the electromagnet will also respond and advance the ratchet wheel by one tooth. Defrosting will therefore always take place after a predetermined number of cooling cycles.

Another favourable possibility resides in that the driving means for the ratchet wheel are a bimetallic element with a heating resistor which is parallel to the thermostat contact and gives off heat to the operating element bellows. Every time the thermostat contact opens, the bimetallic element is heated and advances the ratchet wheel by one tooth. Here, again, defrosting will always take place after a predetermined number of cooling cycles. In addition, the transfer of heat to the bellows ensures that the bellows temperature will always lie above the temperature of the sensor lying against the evaporator, even the case of rapid defrosting with a defrosting heating device. Accordingly, undesirable condensation in the bellows is avoided.

Further, the defrosting time generator may actuate a switch for a defrosting heating resistor, this heating resistor and switch being in shunt with a branch containing the thermostatic switch. In this way it is ensured that the defrosting heating resistor is switched on only when the compressor motor is inoperative. This not only results in the cooling and the heating for defrosting taking place at different times but also permits the defrosting time generator to advance only once per cooling cycle, the heating resistor nevertheless being operated during only a portion of this cycle.

The invention will now be described in more detail with reference to examples shown in the drawings, wherein.

Figure 1:
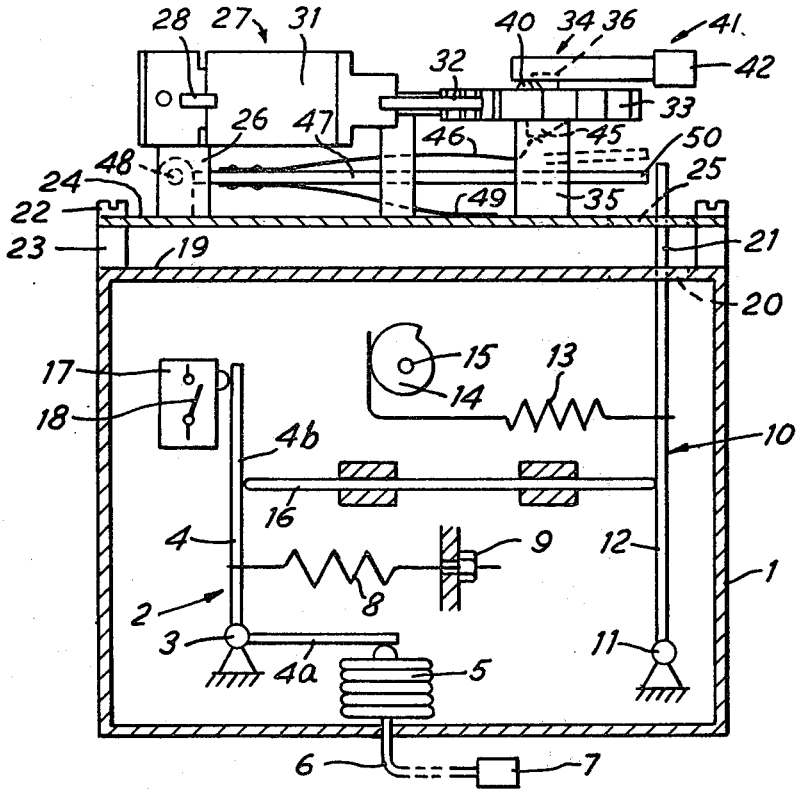
FIG. 1 is a part-sectional diagrammatic representation of a defrosting apparatus according to the invention.

An evaporator thermostat is accommodated in a housing 1. It comprises an actuating element 2 in the form of an angular lever 4 pivotable about a fixed fulcrum 3. An operating element 5 in the form of the bellows of a thermostatic system engages the one arm **4*a* and is connected by a capillary tube 6 to a sensor 7 which is to be applied to the evaporator of a refrigerator. The thermostatic system is provided with a liquid-vapour filling. The liquid proportion is located in the sensor 7 because the evaporator is cooler than are the bellows. A main spring 8 which is provided with a setting device 9 here shown as a nut engages the second arm 4*b*. There is also a transmission element 10 which is in the form of a lever 12 pivotable about a fulcrum 11 and is loaded by a differential spring 13 of which the pretension can be set with the aid of a cam plate 14 or the like rotatable about a shaft 15 provided with a rotary knob. The lever 12 has a force connection by way of a rod 16 to the angular lever 4 of which the lever arm 4*b* acts on a micro-switch 17 with a snap contact 18 and switching hysteresis. Consequently the transmission element 2 is loaded in the one direction by the force of the bellows 5 and the differential spring 13 and in the other direction by the main spring 8, whereby the angular lever is in a state of equilibrium. The position of the angular lever results in switching on and switching off of the snap contact 18 and thus in the switching on and switching off temperature. Both values can be changed in unison by adjusting the cam plate 14**.

The wall 19 of the housing 1 contains an aperture 20 through which an extension 21 of the transmission element 10 projects to the outside. With the aid of screws 22 and spacers 23, a plate 24 is mounted to be parallel to this housing wall 19. The plate 24 has an aperture 25 for the extension 21 and carries the components necessary for controlling the defrosting step.

An electromagnet 27 having a U-shaped core 28 with coil 29 and an armature 31 loaded by a spring 30 is mounted on a support 26. A ratchet spring arrangement 32 with the aid of which a ratchet wheel 33 of a time generator 34 can be advanced is secured to the armature. The ratchet wheel is mounted on a support 35 and rotatable about a shaft 36. The ratchet spring arrangement comprises a driving spring 37 and a braking spring 38. In addition, a fixedly mounted locking spring 39 is provided Two cams which become operative simultaneously are provided on the ratchet wheel 33. The one cam 40 actuates a switch 41 with two contact carriers 43 and 44 held in an insulation fitting 42. The other cam 45 presses by way of a leaf spring 46 on a locking lever 47 which is pivotable about a fixed fulcrum 48 and is loaded by a return spring 49 that is weaker than the leaf spring 46. In addition, its front end forms an abutment 50 for the extension 21 of the transmission element 10 when the locking lever is pressed by the cam 45 out of the rest position shown in broken lines to the illustrated operative position. This results in a switching device S.

When the locking lever 47 assumes the operative position, the transmission element 10 is locked in a predetermined position so that the differential spring 13 no longer acts on the actuating element 2. Accordingly, the latter is now only subjected to the force of the bellows 5 and the main spring 8. Since the bellows is no longer supported by the differential spring 13, the force necessary for switching the contact 18 on and thus the evaporator temperature must be higher than normal. The contact 18 therefore only operates at the so-called defrosting temperature. This can be set in the factory with the aid of the setting device 9 to any desired value, e.g. +6° C. This defrosting temperature does not change when the switching on temperature and the switching off temperature are adjusted with the aid of the cam plate 14.

Figure 2:
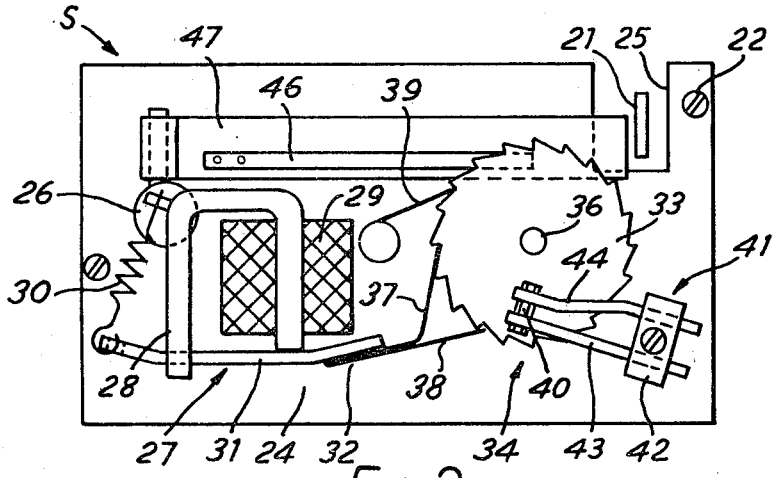
FIG. 2 is a diagrammatic plan view of the defrosting apparatus.
Figure 3:
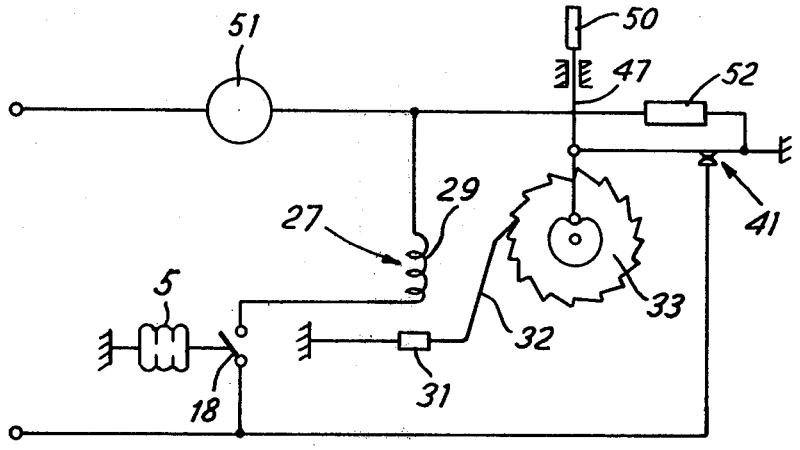
FIG. 3 is a circuit diagram of a first embodiment.

FIG. 3 diagrammatically illustrates a possible circuit for the example of FIGS. 1 and 2. It will be evident that the magnetic coil 29 is in series with the thermostat contact 18 and a motor 51 of the compressor. The ferrite armature 31 of the magnet 27 will therefore always be attracted when the thermostat contact 18 sets the compressor into operation. The series circuit of magnetic coil 29 and thermostat contact 18 is in shunt with the series circuit of a defrosting heating resistor 52 and the associated switch 41. This heating device is therefore operative firstly when the ratchet wheel 33 moves to the defrosting position and thereby closes the switch 41 and secondly when the thermostat contact 18 is opened.

Figure 4:
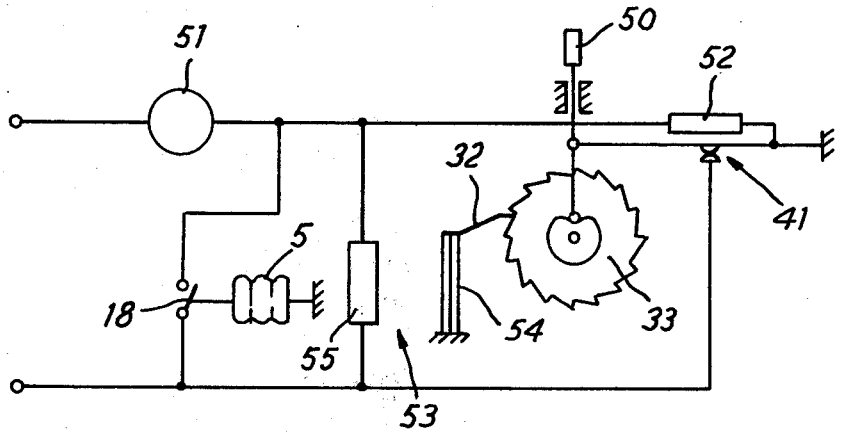
FIG. 4 is a circuit diagram of a second embodiment.

In the embodiment of FIG. 4, the electromagnet 27 is replaced by a driving device 53 consisting of a bimetallic element 54 and an associated heating resistor 55. This heating resistor is arranged so that part of the heat that is produced is transmitted to the bellows 5. The heating resistor 55 is parallel to the thermostat contact 18. Each time the compressor motor 41 has been switched off, the heating resistor 55 is energised and the bimetallic element 54 flexes away so that the ratchet wheel 33 is advanced by one step. During the defrosting period, if the heating resistor 52 heats the evaporator so rapidly that it assumes a higher temperature than the rest of the cooling chamber, there is a danger that the bellows 5 will have a lower temperature than the associated sensor 7 and thus the entire liquid of the thermostatic system will condense in the bellows 5. This is prevented in that the bellows 5 is also heated by the heating resistor 55 just during this time. Since the elements can be mounted in comparatively close juxtaposition, a low heat output will suffice and this will become effective only in the immediate vicinity of the heating resistor 55 whilst leaving the temperature in the rest of the cooling chamber uninfluenced.

There are numerous other possibilities for constructing the defrosting apparatus. For example, a time generator motor may be used which runs simultaneously with the compressor motor. The ratchet wheel may also be operated by different means, e.g. separate bellows controlled by the evaporator temperature.

The heating resistor 55 may in particular be a PTC resistor.

Instead of bellows 5 one may also use a different operating element which produces a force dependent on the temperature, e.g. a diaphragm element or a bimetallic element.

We claim:

1. A control system for a refrigeration assembly of the type which includes a compressor, a compressor motor, and an evaporator, said system comprising a motor switch, fluid pressure operating means responsive to evaporator temperatures, defrosting actuating means having a defrost setting, driving means responsive to the periodic operation of said compressor to cyclically move said defrosting actuating means to its defrost setting after each predetermined number of compressor starts and stops, linkage means between said fluid pressure operating means and said motor switch, main spring means operating on said linkage and opposing said fluid pressure operating means, and differential spring means operatable on said linkage for assisting said fluid pressure means, said differential spring means being made inoperative by said defrosting actuating means during said defrost setting, said differential spring being calibrated so that when both said springs are operating on said linkage said motor switch is actuated at a predetermined evaporator temperature, and said main spring being calibrated to be effective during said defrost setting to actuate said motor switch at a fixed evaporator temperature higher than said predetermined temperature.

2. A control system according to claim 1 wherein said defrosting actuating means includes a ratchet wheel and cam means associated therewith, force transmitting means connecting said differential spring to said linkage means, and movable abutment means operated by said cam means for immobilizing said force transmitting means when said defrosting actuating means has said defrost setting.

3. A control system according to claim 1 characterized in that said fluid pressure operating means is a bellows of a thermostatic system operating with a liquid-vapor filling.

4. A control system according to claim 2 including a housing having an outer wall, said defrosting actuating means being mounted on said outer wall outside said housing, said fluid pressure operating means and said motor switch being mounted inside said housing, said wall having an opening through which said force transmitting means extends.

5. A control system according to claim 4 wherein said transmitting means includes a lever having an extension extending through said wall opening, said movable abutment means being in the path of travel of said extension.

6. A control system according to claim 1 wherein said driving means includes a ratchet wheel and an electromagnet of which the coil thereof is in series with said motor switch.

7. A control system according to claim 1 wherein said driving means includes a ratchet wheel and a bimetallic element, said driving means also including a heating resistor parallel to said motor switch and gives off heat to said fluid pressure operating means.

8. A control system according to claim 1 including a defrosting heating resistor and a resistor switch in series, said resistor switch being operated by said defrosting actuating means, said defrosting heating resistor and said resistor switch being in shunt relative to said motor switch.

* * * * *